US005351599A

United States Patent [19]

Stoll

[11] Patent Number: 5,351,599

[45] Date of Patent: Oct. 4, 1994

[54] LINEAR DRIVE DEVICE

[75] Inventor: Kurt Stoll, Esslingen, Fed. Rep. of Germany

[73] Assignee: Festo KG, Esslingen, Fed. Rep. of Germany

[21] Appl. No.: 849,990

[22] Filed: Mar. 12, 1992

[30] Foreign Application Priority Data

Mar. 14, 1991 [DE] Fed. Rep. of Germany ..... 4108158

[51] Int. Cl.[5] ..... F01B 31/12

[52] U.S. Cl. ..... 91/1; 91/397; 91/361; 91/459; 92/165 PR

[58] Field of Search ..... 91/1, 34, 275, 361, 91/459, 465, 397; 92/5 R, 164, 165 PR

[56] References Cited

U.S. PATENT DOCUMENTS

| | | | |
|---|---|---|---|
| 2,769,298 | 11/1956 | Jones | 91/275 |
| 3,303,755 | 2/1967 | Linker et al. | 91/1 |
| 3,452,645 | 7/1969 | Barltrop | 91/363 |
| 3,479,924 | 11/1969 | Ferguson | 91/459 |
| 4,150,686 | 4/1970 | El Sherif et al. | 91/459 |
| 4,176,586 | 12/1979 | Stoll et al. | 92/5 R |
| 4,561,345 | 12/1985 | Blohm et al. | 91/465 |
| 4,794,841 | 1/1989 | Kemmler et al. | 91/1 |
| 4,814,953 | 3/1989 | Distasio | 362/147 |
| 4,854,218 | 8/1989 | Stoll | 91/1 |
| 4,889,035 | 12/1989 | Goodnow | 91/275 |

FOREIGN PATENT DOCUMENTS

| | | |
|---|---|---|
| 2516495 | 10/1976 | Fed. Rep. of Germany . |
| 3024244 | 1/1981 | Fed. Rep. of Germany . |
| 3130056 | 2/1983 | Fed. Rep. of Germany . |
| 8315785 | 5/1983 | Fed. Rep. of Germany . |
| 8603346 | 2/1986 | Fed. Rep. of Germany . |
| 8632990 | 12/1986 | Fed. Rep. of Germany . |
| 8700899 | 1/1987 | Fed. Rep. of Germany . |
| 3644591 | 7/1987 | Fed. Rep. of Germany . |
| 2150766 | 7/1985 | United Kingdom . |
| 2185863 | 7/1987 | United Kingdom . |

OTHER PUBLICATIONS

English language abstract of JP 58-83202.

*Primary Examiner*—Edward K. Look
*Assistant Examiner*—F. Daniel Lopez
*Attorney, Agent, or Firm*—Flynn, Thiel, Boutell & Tanis

[57] ABSTRACT

A linear drive device has a linear motor which consists of a piston, an output rod and a control rod. The two rods extend through the two end plates of the motor housing. The working or output rod is designed for the transmission of power to some structure. The control rod cooperates a sensor for positioning. The sensor and also a valve arrangement is integrated in the housing end plate associated with the control rod. The valve arrangement controls flow through pressure fluid duct provided in the housing end plate at the control end for actuating the linear motor.

14 Claims, 1 Drawing Sheet

SOLENOID
SOLENOID OPERATED VALVE
SOLENOID
SOLENOID OPERATED VALVE
57
51
50
50
23
40
6
1
40
28
23'
26
28
27
24
27
48
48
III
III
19
38
16
29,35
29,34
29,35'
29,34'
29,33
56
38'
29,33'
II
II 54
25
I
55
50,51
40
23
24
2
3
22
1
60
59
61
65
59'
24
60
23'
16
19
55
56
38
29
20
10
11
9
18
17
21
53
38'
37
6
4
8
5
7
66
P
R
I 43
44
2
1
48
12
34
56
29
5
37
10
11
13
34'
6
43
44
48
35'
8
42
41
7

LINEAR DRIVE DEVICE

CROSS REFERENCE TO RELATED APPLICATIONS

This invention is related to the inventions disclosed in U.S. Ser. No. 07/389,004, filed Aug. 2, 1989 (now U.S. Pat. No. 4,987,822, issued Jan. 29, 1991) and U.S. Ser. No. 07/740,444, filed Aug. 5, 1991 (which was a Rule 62 continuation of U.S. Ser. No. 07/493,922, filed Mar. 14, 1990).

BACKGROUND OF THE INVENTION

The invention relates to a linear drive device comprising a linear motor, which has a motor housing with a housing cavity, in which an axially displaceable piston separates two working spaces from each other and which together with a power output rod and a control rod constitutes a common moving drive unit, the two rods being arranged on opposite axial sides of the piston and, extending through the respectively associated housing end plate, which shuts off the housing cavity at the end thereof, extend out of a power output end and a control end of the motor housing, an electrically operated actuating device in the form of a valve device having a solenoid for effecting the supply and/or discharge of pneumatic or hydraulic fluid in relation to at least one working space for actuating the linear motor, and at least one sensor for responding to certain positions of translation of the control rod, the valve device, solenoid and the sensor being arranged adjacent to the control end of the linear motor.

In the case of a linear drive device of this type as for instance described in European patent publication 10 355 179 A, the linear motor is more particularly designed in the form of a piston and cylinder unit, whose piston rod represents the actuating or output rod, which is able to be connected with a component to be moved or with some other part to be acted upon. In this case the control rod together with at least one sensor is responsible for producing control signals on the basis of which the valve arrangement is operated, which is responsible for the distribution of working fluid to the working spaces of the linear motor. A control device is provided for processing the control signals and the operation of the valve arrangement, such control device generally being mounted externally.

This known linear drive device already has the advantage that the main components are joined together as a unit able to be handled as such. However, the space requirement for this device is still excessive for many applications more particularly owning to the valve arrangement and sensors placed to the side of the control rod. Furthermore a flange-mounted holding structure is necessary at one end in order to attach these parts securely and in a manner free of vibration. A further point to be considered is that the assembly of the valve arrangement and of the sensors on the holding structure is slow, because free, exposed working fluid lines and control lines are still necessary.

SHORT SUMMARY OF THE INVENTION

One object of the present invention is to provide a linear drive device of the type initially mentioned which while having a compact design is characterized by enhanced economy in the space requirement.

A still further object of the present invention is to provide such a linear drive system which is simpler to mount and fit.

In order to achieve these and/or other objects, the valve arrangement and the sensor are carried on the housing end plate adjacent to the control end, the valve arrangement being seated in at least one receiving well in the housing end plate adjacent to the control end, in the interior of the housing end plate adjacent to the control end fluid ducts are formed which connect fluid connection means, arranged on the outside of the housing end plate with at least one of the working spaces which are controlled by the valve arrangement. On the outer side of the housing end plate at the control end first electrical connection means are provided which, via electrical lines extending in the interior of the housing end plate, are connected with the actuating device of the valve arrangement. On the outer side of the housing end plate at the control end a second electrical connection means is provided which is connected via control lines with the sensor.

In this manner the invention provides a linear drive device wherein both the sensors and also the valve device are practically integrated in the housing end plate at the control end so that external hoses and cables are generally unnecessary. The result is a compact component, the valve device assuming a position within the housing end plate whereat it is protected and wherein it is not responsible for any widening of the conventional overall size of the unit. The connection of a control device and of a pressure fluid supply is very simple and may be performed by a connection with the fluid power and electrical connection means in a time-saving manner. On the valve arrangement itself it is unnecessary to connect any hose pipe, something that completely excludes the danger of confusion of connections. Lastly, complex holding structures are no longer necessary, because the valve arrangement and the sensors are arranged on the linear motor. All in all, the result is an extremely slim external configuration without any broadening out in excess of ISO Standard dimensions.

Preferably the valve arrangement comprises two valves, which are respectively in the form of 3/2 way valves and are respectively responsible for the supply and discharge of working fluid in relation to one of the two working spaces.

It is furthermore an advantage if the control lines of the sensors are essentially and preferably completely within the interior of the housing end plate at the control end so that there is no danger of damage.

The connection means provided on the housing end plate are expediently joined together with each other as multiple connection devices which are termed so-called multipole connection means. They are preferably designed in the form of plug and socket connection means so that instant make and break of the connection is possible.

If on the housing end plate at the control end two sensors are provided for cooperation with the control rod, on the one hand, and with the piston rod, on the other hand, position detection means, as for instance an electrical one, for sensing the position of the drive unit in both directions of the stroke may be employed. Furthermore in order to ensure that a switching spur of the control rod always assumes the correct position relation to the associated sensor, it is preferred to provide the control rod with a non-circular and, more particularly, a rectangular cross section so that it is prevented from twisting about its axis.

It is furthermore preferred to provide abutment means on the housing end plate at the control end in order to limit the stroke of the drive unit, which renders possible a very sensitive fine adjustment as for instance down to exactly 1/100 mm.

Furthermore together with a suitable control device it is possible for the linear drive device to be operated with a stroke speed which is up 30% higher than in known drive equipment if the supply of working fluid is suitably regulated by operation of the valves.

Further advantageous developments and convenient forms of the invention will be gathered from the following detailed account of one embodiment thereof in conjunction with the accompanying drawings.

LIST OF THE SEVERAL VIEWS OF THE DRAWINGS

Figure 1:
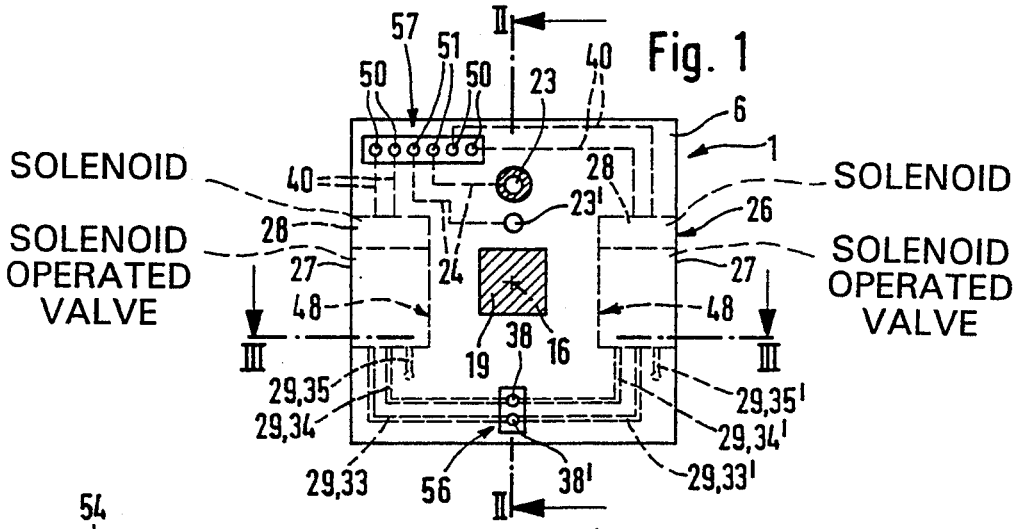
FIG. 1 shows first embodiment of the invention as a linear drive device as seen from the rear in a cross section taken on the section line I—I of FIG. 2, the components integrated in the housing end plate being indicated in broken lines.
Figure 2:
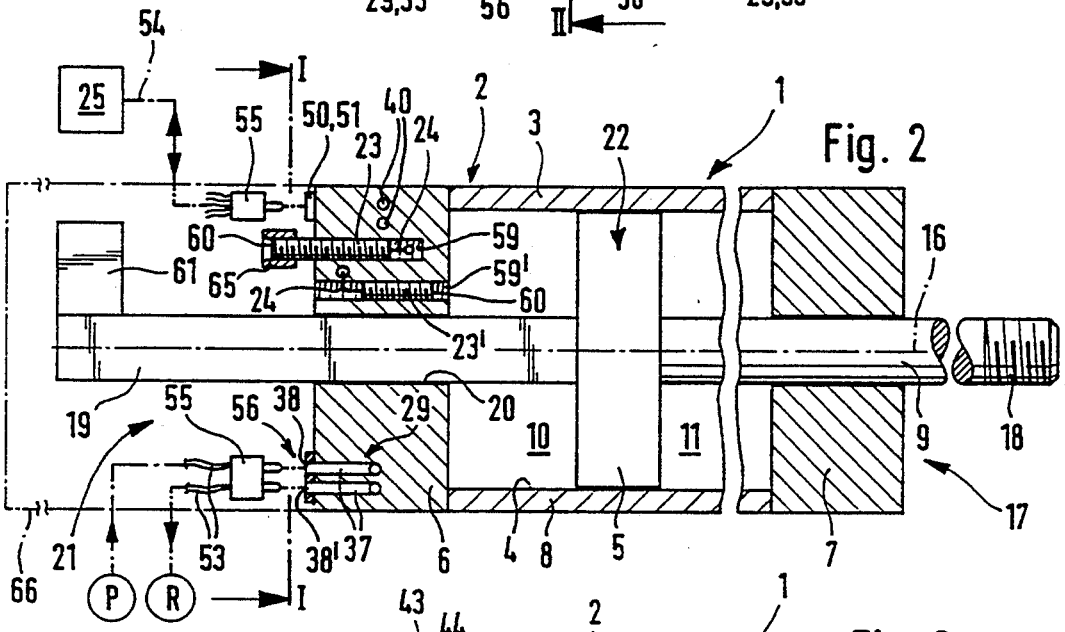
FIG. 2 shows the linear drive device in accordance with FIG. 1 in a longitudinal section taken on the line II—II.
Figure 3:
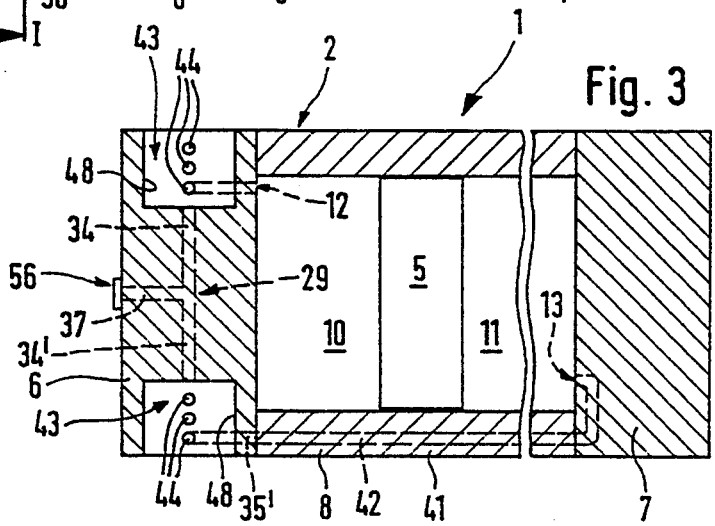

FIG. 3 also shows a longitudinal section taken through the linear drive device of FIG. 1 in accordance with the second line III—III in a section plane extending perpendicular in relation to FIG. 2 and after removal of the valve device.

DETAILED ACCOUNT OF WORKING EMBODIMENTS OF THE INVENTION

All figures are purely diagrammatic. The linear drive device generally referenced 1 in the figures possesses as its main component a linear motor 2, which is designed in the form of a piston and cylinder unit. The linear motor 2 has a motor housing 3 with a tubular portion 8, in which a housing space is formed, which functions as the bore receiving a piston 5 adapted to run axially therein. The ends of the motor housing 3 are shut off by two housing end plates 6 and 7, which constitute the axial limitation of the housing space 4 as well. They may optionally be make integrally with the tubular section 8, but in the working embodiment they are designed as a separate component.

Using seals, not illustrated in detail, the piston 5 divides the housing space 2 into two working spaces 10 and 11. Both of them are able to be vented or pressurized with a pressure fluid such as a compressed air, for which purpose there are ducts to be described below and which as shown in FIG. 3 open at 12 and 13 into the two working spaces 10 and 11.

One side of the piston 5 is connected with a drive or output rod 9, which extends in the axial direction 16 which coincides with the direction of displacement of the piston 5 and extends to the outside at the end 17 of the drive assembly after passing through the associated housing end plate 7 and a seal therein. The outwardly extending working section 18 constitute the power transmission or power output member which is able to be connected with any desired structure.

The opposite side of the piston 5 bears a control rod 19 which is coaxially mounted in relation to the output rod 9, which extends through the housing end plate 6 associated with it and in an opening 20 in the end plate to the outside and at the control end 21, opposite to the power output end 7.

The output rod 9, the piston 5 and the control rod 19 are collectively referred to as a jointly moving device unit 22.

The control rod 19 is adapted to cooperate with at least one sensor 23, which responds at certain positions of displacement of the drive unit 22 so that practically the respective position of displacement may be detected or ascertained. There are control lines 24 for conducting the signals produced to a diagrammatically illustrated control device 25, which for its part is able to operate a valve arrangement 26 in a manner dependent on such signals, which in the working embodiment shown consists of two valves 27, which are preferably in the form of 3/2 way valves. The valves 27 possess an actuating device 28, which is only diagrammatically illustrated, such as an electrically operated solenoid which may be operated to regulate the supply of working fluid to an/or discharged from the two working spaces 10 and 11 in order to operate the linear motor by causing the drive unit 22 to perform an axially directed movement.

The openings 12 and 13 are connected with the pressure ducts 29 which extend in the housing end plate 6 at the control end. More specifically, in the embodiment of the invention for each valve 27 in the housing end plate 6 at the control end there is a feed duct 33 and 33', a venting duct 34 and 34' and a power duct 35 and 35'. Internally the two feed ducts 33 and 33' and the two venting ducts 34 and 34' are each connected with each other at one end. Each pair 33 and 33' and, respectively, 34 and 34' of ducts produced in this manner is furthermore connected with a fluid connection means 38 and 38', which is arranged adjacent to the outer surface of the housing end plate 6 at the control end. Furthermore it is possible for branch ducts 37 to be provided in the housing end plate 6 at the control end, which function to connect the respective pair of ducts with the respective connection means 38 and 38'.

One of the power ducts 35 opens at one end at 12 with the working space 10 at the control end. The other power duct 35' has its one end connected to a supply duct 42, which runs in the wall 41 of the tubular portion 8 axially to the side along the housing space 4 towards the housing end plate 7 at the control end in order to finally open at 13 into the working space 11.

The ducts 33, 34, 35 and respectively 33', 34' and 35' associated with the respective valve 27 have their respectively other ends opening at mounting emplacements 43 for component, the openings being illustrated in FIG. 3 at 44. At these mounting emplacements a respective one of the valves 27 is so detachably mounted that the internal valve ducts are connected in a known manner with the associated openings 44. The mounting emplacements 43 are in this case part of receiving wells 48 of which for each valve one is placed in the housing end plate 6 at the control end and in which the valve 27 are mounted, preferably so that they are completely sunk thereinto. This leads to a compact arrangement with a substantially smooth surface and no substantial projecting parts.

In the embodiment of the invention the two receiving wells 48 are spread out around the periphery of the control rod 19 with a spacing in the circumferential direction of the housing end plate 6 at the control end and in relation to the longitudinal axis 16 are diametrically opposite to each other. In this respect it is a question of cubic receiving wells or recesses 48, which are designed in the form of pockets and whose openings are oriented radially outward. At the axial end and at the periphery the receiving wells 48 are therefore preferably limited by the material of the housing end plate 6. The assembly of the valve 27 is preferably performed as part of a plugging in operation.

The housing end plates 6 and 7 preferably have a rectangular cross section and, in the case of the invention, are square in outline. The two receiving wells 48 are in this case preferably located adjacent to opposite, parallel side surfaces and preferably adjacent to the respective midpoint of the side as shown in FIG. 1.

Furthermore first electrical connection means 50 are provided on the outer side of the housing end plate 6 at the control end, such means being connected via electrical lines 40, running inside the housing end plate 6 at the control end, with the actuating means 28 of the two valves 27.

Furthermore, in addition to the above noted sensor 23, there is a further sensor 23' held on the housing end plate 6 at the control end and which cooperates with the piston 5 for excitation thereof. Both the sensors 23 and 23' are connected with the above noted control lines 24, which are preferably arranged to run inside the housing end plate 6 at the control end and lead to second electrical connection means 51 arranged on the outside of the housing end plate.

The housing end plate 6 at the control end therefore constitutes a highly integrated component, on which both the valve arrangement 26 and also the sensors 23 and 23' and the fluid and electrical connection means 38, 38' and 50, 51' are arranged.

The electrical lines 40 and the control lines 24 may be designed in the form of printed wiring. In the embodiment of the invention, cables are utilized which are laid in suitable ducts and recesses in the housing end plate.

The fluid connection means 38 and 38' render possible the connection of external fluid connection members 53 such as pressure fluid lines or pressure fluid hose in order to produce a connection with a pressure fluid source P and/or to a point R, to which air from a working space is to be vented. The electrical connection means 50 and 51 make possible the connection of electrical connection members such as cables 54 and the like, which in the working embodiment lead to control means 25.

Since in the case of the working embodiment all connection means 38 and 38' 50 and 51 are designed in the form of plugs and sockets therefor, it is possible for the connection members to be connected or terminated by a plugging action. The associated connection ends of the connection members 53 and 54 are for this purpose provide with plugs 55 complementary to the connection means of the housing end plates. In order to ensure that it is unnecessary for each supply member to be connected separately, the fluid connection means 38 and 38' are combined together to form a multiple fluid power connection device 56 and the electrical connections 50 and 51 are combined together to form an electrical multiple connection device 57, which connection devices are termed so-called multipole connection devices. In the case of the plugs, suitable multiple plugs are utilized.

As regards the electrical connection means it is furthermore advisable to arrange the first and the second electrical connection means 50 and 51 in separate groups of multiple connection means.

Of the fluid power connection means 38 and 38' one is provided for the pressure fluid source P and the other is provided for the discharge point R. However it will be clear that in case of need it is possible to do without a connection means 38' joined with a discharge point R, if venting is able to take place directly into the surroundings of the linear drive assembly 1. In this case only one external supply duct is necessary so that the design only has a minimum amount of hose.

The two sensors 23 and 23' are in the working embodiment essentially in the form of rods or pins and each have a threaded section with which they are screwed into the threaded holes 59 and 59' in the housing end plate 6 at the control end and which extend in the axial direction 16. For the sensor 23 in cooperation with the control rod 19 the threaded hole 59 is preferably a blind hole extending in from the control end 21 and the sensor 23 screwed into the same has its detection or signal part 60 extending to a larger or smaller extent past the axial end surface of the housing end plate 6 at the control end.

The control rod 19 has, on its part outside the motor housing 3, a radially projecting switching spur 61, which is moved with the control rod 19 and into its displacement path the detection part 60 preferably extends. The detection part 60 and the switching spur 61 are preferably in axial alignment with each other. If during operation of the assembly the switching spur 61 approaches the detection part 60 by a certain amount, the sensor 23 will respond.

In order to economize in space, the switching spur 61 is preferably not in the form of a flange or a ring but only in the form of a project lug or a pin. In order to nevertheless ensure a correct position in relation to the sensor 23, the control rod 19 has a non-circular cross section, in the present working embodiment, a square one. The shape of the opening 20 in the end plate is complementary so that a simple way of prevention relative twist is provided.

For the sensor 23' cooperating with the piston 5 there is a threaded hole 59' extending axially through the housing end plate 6 at the control end and into which the sensor 23' is screwed from the outside. Its detection point 60 is arranged on the side in front of the piston 5 so that practically the two sensors 23 and 23' are associated with opposite axial sides of the housing end plate 6 at the control end. Preferably however the detection part 60 is sunk into the interior of the threaded hole 59' so that there is no risk of impact of the piston 5 against it. If the sensor 23 is also provided with abutment means or other abutment means are provided, it is possible naturally for it to extend into the interior of the working space 10.

The outer sensor 23 is in the working embodiment provided with an abutment means 65 in order to limit the stroke of the drive unit. This abutment means 65 practically constitutes a subassembly with the sensor 23 and for this purpose is constituted by an abutment sleeve, which, provided with an internal screw thread, is so screwed on the free end of the sensor 23 that the detection part 60 is sunk into the sleeve recess. Accordingly if the piston 5 moves towards the working end 17, the switching spur 61 will as part of this movement run up against the end of the abutment means 65, the sensor 23 then preferably responding.

It will be clear that optional abutment means may be arranged separately alongside the sensors on the housing end plate 6.

Owing to the possibility of axial displacement of the sensors 23 and 23' and/or of the abutment means 65, it is possible to very exactly set the desired ends of the strokes. In the illustrated working embodiment of the invention, it is only necessary to screw the sensors in the threaded hole or to screw the sleeve-like abutment means 65 onto the associated sensor.

The connection means 38, 38', 50 and 41 are preferably arranged on the control side of the end plate 6 at the control end. In this case connected members 53 and 54 do not extend radially clear of the other parts so that a slim and compact structure is provided. The two sensors 23 and 23' and, respectively, the associated threaded holes 59 and 59' are preferably arranged radially in succession with respect to the longitudinal axis 16, while in the axil direction as seen in FIG. 1 they are preferably aligned on a longitudinal median axis of the housing end plate 6 with a square outline. On the same line the fluid power connection means 38 and 38' are preferably also arranged, but however preferably diametrically opposite to each other with respect to the longitudinal axis 16. The receiving wells 48 or recesses are preferably arranged with bilateral symmetry with respect to this connecting line to the left and to the right. Furthermore, and as shown in FIG. 1, the electrical connection means 50 and 51 are preferably arranged in a corner part of the housing end plate 6 at the control end.

Operation of the device is now possible in such a manner that the two valves 27 are switched alternatingly via the control device 25 so that the drive unit 22 performs a reciprocating movement. Reversal of the stroke direction takes place using the sensors 23 and 23', which on the approach of the piston 5 or, respectively, of the switching spur 61 produce a signal which is passed to the control device 25, which then correspondingly reverses the actuating device of means 28.

Owing to the extremely short fluid power paths there is a great saving in compressed air, in the case of pneumatic equipment of up to 20%. Furthermore the response behavior is favorably affected thereby. The low compressed air requirement renders possible a further saving in costs, since only very small valve dimensions are necessary. The sensor control system is very favorable in price since it is possible to do without solenoids. By suitable programing of the control device 25 it is possible to operate the valves in an extremely adaptable manner such as, for instance, a manner in which the drive unit is run at a high speed, while on reaching the end of a stroke there is a reduction of the speed for a very short part of the stroke.

At 66 it is possible to provide a protective boot at shown in broken lines, which on the control end my be mounted on the housing end plate 6 in order to accommodate members arranged here without danger to the operator. The annular portion 8 is expediently designed with a non-circular form, for instance square, like the housing end plates 6 and 7.

The embodiments of the invention in which an exclusive property or privilege is claimed are defined as follows:

1. A linear drive device comprising:

a linear motor having an elongated motor housing with an internal housing cavity oriented between first and second housing end plates, in which cavity is mounted an axially displaceable piston which separates the cavity into two separate working spaces and which together with a power output rod and a control rod connected to and on opposite sides of the piston and movable with the piston constitutes a common drive unit, the output rod and the control rod extending through the respectively associated one of the first and second housing end plates, the output rod extending through the first housing end plate at a power output end and the control rod extending through the second housing end plate at a control end of the motor housing;

a valve device having an electrically operated actuating device for effecting a supply and/or discharge of pneumatic or hydraulic fluid in relation to at least one working space for actuating the linear motor;

at least one sensor for responding to certain positions of translation of the control rod, both the valve device and associated actuating device and the sensor being mounted on the second housing end plate, said valve device and said associated actuating device being seated in means defining at least one receiving well in the second housing end plate;

means defining first fluid ducts in the second housing end plate and at least one second fluid duct extending in a wall of said motor housing alongside the working spaces, at least one of said first fluid ducts being connected to the valve device for controlling fluid flow to said working spaces through said first and second fluid ducts, said at least one of said second fluid ducts opening at one end thereof into the working space adjacent to the power output end and at the other end thereof being connected with said first fluid duct in the second housing end plate connected in fluid circuit with the valve device;

fluid connection means arranged on an exterior of the second housing end plate connected in fluid circuit with said first and second fluid ducts and at least one of the working spaces through the valve device;

first electrical connection means provided on the exterior of the second housing end plate and being connected with the actuating device of the valve device, said first electrical connection means including passageway means in the second housing end plate and electrical wiring extending through said means; and second electrical connection means on the exterior of the second housing end plate and being connected with said at least one sensor, said at least one sensor including control lines extending at least substantially in the interior of the second housing end plate through said passageway means.

2. The linear drive device as claimed in claim 1, wherein the valve device comprises two valves which are respectively responsible for the supply to and/or discharge of working fluid from one of the two working spaces.

3. The linear drive device as claimed in claim 2, wherein the two valves of the valve device are 3/2 way valves.

4. The linear drive device as claimed in claim 2, wherein two receiving wells for the two valves are each arranged adjacent a periphery of the control rod offset from one another in a circumferential direction on the second housing end plate.

5. The linear drive device as claimed in claim 4, wherein the two receiving wells are diametrically spaced on the second housing end plate.

6. The linear drive device as claimed in claim 4, wherein the two valves are each removably received in the respective receiving wells therefor.

7. The linear drive device as claimed in claim 2, wherein the two valves are each completely recessed into the interior of the second housing end plate.

8. The linear drive device as claimed in claim 1, wherein the first and second electrical connection means are combined in the form of at least one multipole connection means.

9. The linear drive device as claimed in claim 1, comprising abutment means arranged on the second housing end plate in order to limit the stroke of the drive unit and which may be adapted for cooperation with at least one of the control rod and the piston.

10. The linear drive device as claimed in claim 1, wherein the position of the sensor arranged on the second housing end plate is adjustable in the displacement direction of the drive unit.

11. The linear drive device as claimed in claim 1, including an additional sensor arranged on the second housing end plate, one sensor operatively cooperating with the control rod and the other sensor operatively cooperating with the piston.

12. The linear drive device as claimed in claim 11, wherein the two sensors are operatively positioned at opposite axial ends of the second housing end plate.

13. The linear drive device as claimed in claim 1, wherein said control rod has a radially projecting switching spur on a portion thereof extending outside the motor housing, said spur being adapted for cooperation with the sensor arranged on the second housing end plate in the path of displacement of the switching spur.

14. The linear drive device as claimed in claim 1, wherein said control rod has a non-circular cross section.

* * * * *

UNITED STATES PATENT AND TRADEMARK OFFICE

CERTIFICATE OF CORRECTION

PATENT NO. : 5 351 599

DATED : October 4, 1994

INVENTOR(S) : Kurt STOLL

It is certified that error appears in the above-identified patent and that said Letters Patent is hereby corrected as shown below:

Column 8, line 48; after "said" insert ---passageway---.

Signed and Sealed this

Fourteenth Day of February, 1995

*Attest:*

*Attesting Officer*

BRUCE LEHMAN

*Commissioner of Patents and Trademarks*